US005842227A

United States Patent [19]

Rabin et al.

[11] Patent Number: 5,842,227

[45] Date of Patent: Dec. 1, 1998

[54] FINGER PROTECTOR FOR SURGEONS

[75] Inventors: Jill M. Rabin; Phyllis A. Shaw, both of New York, N.Y.

[73] Assignee: Long Island Jewish Medical Center, New Hyde Park, N.Y.

[21] Appl. No.: 12,024

[22] Filed: Jan. 22, 1998

[51] Int. Cl.[6] ..... A41D 13/08

[52] U.S. Cl. ..... 2/21; 2/2.5

[58] Field of Search ..... 2/21, 161.7, 163, 2/2.5, 167, 16; 223/101; 128/879, 880; 132/285, 319, 73

[56] References Cited

U.S. PATENT DOCUMENTS

| | | | |
|---|---|---|---|
| 540,975 | 6/1895 | Grimes | 2/21 |
| 1,036,017 | 8/1912 | Skaggs | 2/21 |
| 1,337,957 | 4/1920 | Rasmussen | 2/21 |
| 1,916,921 | 7/1933 | Dougan | 2/21 |
| 2,039,505 | 5/1936 | Vollmer | 2/21 |
| 3,511,242 | 5/1970 | Agnone . | |
| 4,214,321 | 7/1980 | Nuwayser . | |
| 4,858,245 | 8/1989 | Sullivan et al. . | |
| 4,873,998 | 10/1989 | Joyner | 2/163 |
| 4,944,437 | 7/1990 | Calvert | 2/21 |
| 4,995,119 | 2/1991 | Codkind | 2/161.7 |
| 5,450,626 | 9/1995 | Sorrels | 2/21 |
| 5,497,510 | 3/1996 | Knowles et al. | 2/21 |
| 5,609,165 | 3/1997 | Lambert | 2/161.7 |
| 5,706,520 | 1/1998 | Thornton et al. | 2/21 |
| 5,761,743 | 6/1998 | Andrews et al. | 2/161.7 |

*Primary Examiner*—Amy Vanatta
*Attorney, Agent, or Firm*—Amster, Rothstein & Ebenstein

[57] ABSTRACT

A finger protector, for use by surgical personnel under a surgical glove during a surgical procedure to prevent a finger puncture or cut, includes a puncture- and cut-resistant flexible, thin tube. The tube is open at one end and closed at an opposite end, the tube tapering outwardly from the closed end to the open end. The tube is adapted to extend over the entire circumference of a finger from a fingertip to at least the third metacarpal-phalangeal joint, and combines levels of proprioception and flexibility suitable for surgical purposes. Preferably the tube is formed of ethyl vinyl acetate (EVA), about 0.080 cm thick, and extends substantially over at least the palmar surface and sides of the remainder of the finger, at least up to the second metacarpal-phalangeal joint.

11 Claims, 1 Drawing Sheet

FIG. 1
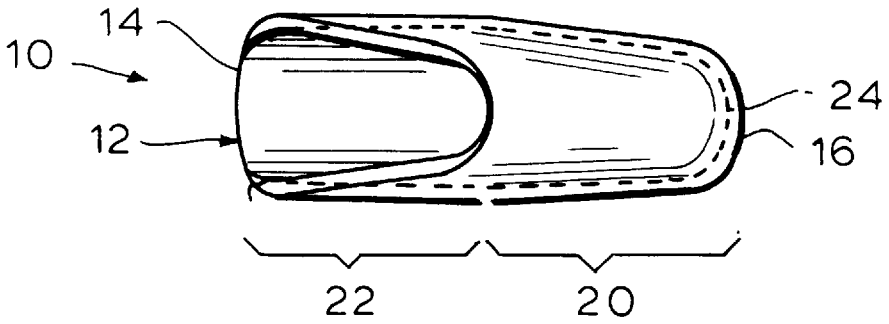
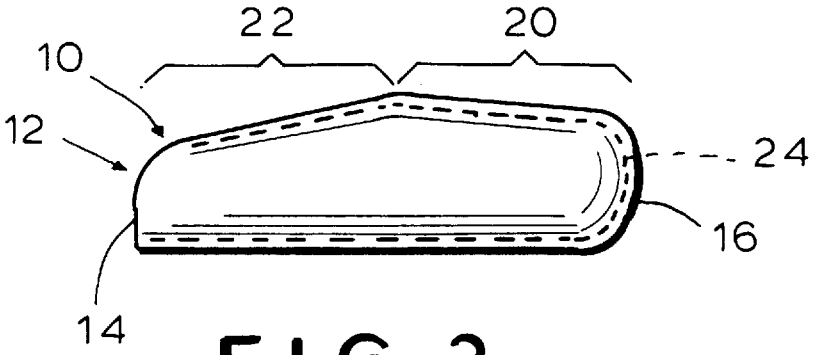
FIG. 2
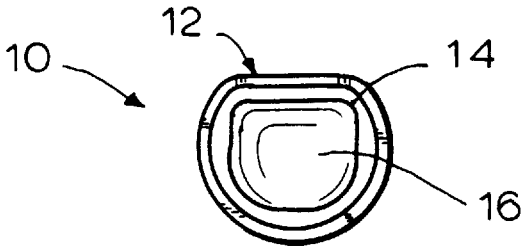
FIG. 3

FINGER PROTECTOR FOR SURGEONS

BACKGROUND OF THE INVENTION

The present invention relates to a finger protector and, more particularly, a finger protector for use by surgical personnel under a surgical glove during a surgical procedure to prevent a finger puncture or cut.

While the present invention is described herein in terms of a finger protector for use by surgical personnel under a surgical glove during a surgical procedure to prevent a finger puncture or cut, clearly it is equally useful to other professionals who perform work which involves the risk of puncture or cut to a finger. Such personnel might include chefs, construction workers, fabric cutters, shoe makers and the like.

A finger protector for use in the surgical field must not only afford a high level of protection against HIV and other viruses and bacteria where sharp instruments are used and may result in knife or needle sticks, but must also satisfy additional requirements. Needle penetration (i.e., puncture) is more of a risk than knife penetration (i.e., cut) because, during surgery requiring direct needle guidance, considerable pressure is applied (typically by the non-dominant index finger) against the needle in order to provide needle guidance. Thus, a satisfactory finger protector must prevent both needle puncture and knife cut.

The most important additional requirements are that the finger protector be able to withstand constant needle pressure for a period of time ranging from thirty seconds to several minutes while a needle is being guided from one area of the body to another. For example, during urethropxy, an abdominal needle is placed and guided by the finger through the retropubic space into the vagina, a procedure which can take five to ten minutes. The needle would be guided from an abdominal position by the surgeon's dominant hand onto the vaginally placed non-dominant index finger of the surgeon, thereby bringing the needle from an abdominal position into a vaginal position on the tip of the surgeon's non-dominant index finger.

At the same time, the finger protector must provide enough flexibility so that the surgeon is not hampered in the use of his finger. And, further, the finger protector must afford sufficient proprioception for surgical work (that is, to feel through vibration and/or direct touch the tip of a needle or scalpel) to enable needle or blade placement.

The finger protector should also be as thin as possible so as to occupy as little room as possible, thereby to minimize obstruction of visualization or limitation of the field of the operative site. More particularly, the finger protector should be capable of use in cylindrical small cavities such as the vagina, rectum, bladder, mouth and laproscopic incisions, without unduly occupying the cavity, obscuring the surgical field, or increasing the difficulty of manipulation. The finger protector should, by itself, after insertion, remain in place on the finger it is designed to protect (albeit underneath a surgeon's glove in the case of a surgical finger protector) so that additional space is not required in order to permit attachment of a mechanism to maintain the finger protector in place.

In order to minimize tension on the tissues, and in order to encourage the sliding of a needle thereover during needle placement, the outer surface of the finger protector should be relatively smooth.

While finger protectors formed of metal have been described in the prior art, they are typically incapable of providing the desired flexibility and proprioception required for surgical work. Typically, they interfere with the dexterity of the surgical surgeons fingers, do not transmit the feeling sensation, and provide generally poor manipulative quality.

Accordingly, it is an object of the present invention to provide a finger protector for preventing a finger puncture or cut.

Another object is to provide such a finger protector which can withstand constant needle pressure from thirty seconds to several minutes during a surgical procedure.

A further object is to provide such a finger protector which affords a level of flexibility and proprioception suitable for surgical purposes.

It is another object of the present invention to provide such a finger protector which is thin and of minimal bulk so as not to obscure the operative site or unduly occupy space therein.

It is a further object to provide such a finger protector with a smooth outer surface which may include a needle seat.

SUMMARY OF THE INVENTION

The above and related objects of the present invention are obtained in a finger protector for use by surgical personnel under a surgical glove during a surgical procedure to prevent a finger puncture or cut. The finger protector comprises a puncture- and cut-resistant flexible, thin tube. The tube is open at one end and closed at an opposite end, the tube tapering outwardly from the closed end to the open end. The tube is configured and dimensioned to extend over the entire circumference of a finger from a fingertip to at least the third metacarpal-phalangeal joint, and combines levels of proprioception and flexibility suitable for surgical purposes.

In a preferred embodiment, the tube is formed of ethylene vinyl acetate (EVA), about 0.080 cm thick. It extends substantially over at least the palmar surface and sides of the remainder of the finger, at least up to the second metacarpal-phalangeal joint.

The tube may define a needle seat on the outer surface of the closed end, and preferably configured and dimensioned to receive a non-dominant index finger.

BRIEF DESCRIPTION OF THE DRAWING

The above and related objects, features and advantages of the present invention will be more fully understood by reference to the following detailed description of the presently preferred, albeit illustrative, embodiments when taken in conjunction with the accompanying drawing wherein:

FIG. 1 is a top view of a finger protector according to the present invention;

FIG. 2 is a side elevational view thereof; and

FIG. 3 is an end elevational view thereof taken in the direction of arrow 3 of FIG. 2.

DETAILED DESCRIPTION OF THE PREFERRED EMBODIMENTS

Referring now to the drawing, and in particular to FIGS. 1–3 thereof, therein illustrated is a finger protector according to the present invention, generally designated by the reference numeral 10. The protector may be used by surgical personnel under a surgical glove during a surgical procedure to prevent a finger puncture or cut, but may also be used by other professionals who are at risk of a finger puncture or cut during work (either under a glove or not).

The finger protector 10 comprises a puncture- and cut-resistant flexible, thin tube, generally designated 12. The longitudinally-extending tube 12 is open at one end 14 (the proximal end) and closed at an opposite end 16 (the distal end). The tube 12 tapers outwardly from the closed end 16 to the open end 14 as necessary to accommodate a finger. Typically, the finger most at risk in a surgical procedures is the non-dominant index finger of the surgeon. Thus the tube 12 is preferably configured and dimensioned to receive a non-dominant index finger, but it may be configured and dimensioned to receive any finger or group of adjacent fingers. Different sized tubes may be provided to accommodate individuals of different finger size.

In a preferred embodiment, the distal portion 20 of the tube 12 is configured and dimensioned to extend over the entire circumference of a finger, from the fingertip of the finger to at least the third metacarpal-phalangeal joint of the finger. The distal portion 20 has a generally oval cross section and preferably fits snugly on the finger and suffices to retain the tube 12 on the finger until the tube 12 is forcibly removed therefrom. The proximal portion 22 of the tube 12 has a generally half or ¾ oval cross section and is configured and dimensioned to substantially cover at least the palmar surface and both lateral sides of the remainder of the finger. Preferably the proximal portion 22 extends at least up to the second metacarpal-phalangeal joint of the finger.

The tapering of the tube 12 allows an easy fit of the tube into a cylindrical body cavity or like relatively small space, such as the vagina, rectum, mouth or laproscopic opening where space is typically limited. The tapering allows the surgeon to operate in the maximum available space remaining in the body cavity without obscuring his/her vision.

The tube 12 is preferably formed of ethyl vinyl acetate (EVA). While other materials may be employed, EVA has been found to provide levels of proprioception and flexibility suitable for surgical purposes as well as the pressure- and cut resistance critical to a finger protector. The tube wall is thin, preferably about 0.080 cm thick, although EVA is available in thicknesses from 0.04 to 0.02 centimeters.

EVA enables direct needle guidance because of its ability to withstand constant needle pressure from 30 seconds to several minutes while the needle is being guided from one part of the area of the body to another. Additionally, EVA affords excellent feel quality or proprioception, thereby permitting a high level of manipulation and dexterity. While the tube 12 may be provided with transversely-extending creases to facilitate flexing of the finger at the metacarpal-phalangeal joints, the flexibility of EVA is such that the transversely-extending creases are typically not required. EVA is thermo-formable, thereby facilitating manufacture of the tube 12 in the desired configuration and dimensions. As noted above, other materials affording a relative impermeability to puncture by a needle or cut by a scalpel, while affording a high level of flexibility and proprioceptive qualities, may be used instead of EVA.

The closed end 16 may define a groove or needle seat 24 at the tip thereof to facilitate needle stabilization during surgery—e.g., transvaginal surgery including urethropxy, pelvic floor reconstruction, hysterectomy, and various other bladder, vaginal and rectal surgeries. Depending upon the preference of the surgeon, the needle seat 24 may extend either vertically or horizontally along the distal end 16 of the fingertip as a groove or recess.

To summarize, the present invention provides a finger protector for preventing a finger puncture or cut, the finger protector affording a level of flexibility and proprioception suitable for surgical purposes. Preferably the finger protector can withstand constant needle pressure from thirty seconds to several minutes during a surgical procedure. The finger protector is thin and of minimal bulk so as not to obscure the operative site or unduly occupy space therein. It is provided with a smooth outer surface and may include a needle seat.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. A finger protector for use by surgical personnel under a surgical glove during a surgical procedure to prevent a finger puncture or cut, said finger protector comprising:

a puncture- and cut-resistant flexible, thin tube, open at one end and closed at an opposite end, said tube tapering outwardly from said closed end to said open end;

said tube being configured and dimensioned to extend over the entire circumference of a finger from a fingertip to at least the third metacarpal-phalangeal joint;

said tube defining a grooved needle seat on an outer surface of said closed end;

said tube combining levels of proprioception and flexibility suitable for surgical purposes.

2. The finger protector of claim 1 wherein said tube is formed of ethyl vinyl acetate (EVA).

3. The finger protector of claim 2 wherein said EVA is about 0.080 cm thick.

4. The finger protector of claim 1 wherein said tube extends substantially over at least the palmar surface and sides of the remainder of the finger.

5. The finger protector of claim 1 wherein said tube extends at least up to the second metacarpal-phalangeal joint.

6. The finger protector of claim 1 configured and dimensioned to receive a non-dominant index finger.

7. The finger protector of claim 1 wherein said thin tube is thermoformed and defines a smooth outer surface tapering outwardly from said closed end to said open end.

8. A finger protector for preventing a finger puncture or cut, said finger protector comprising:

a puncture- and cut-resistant flexible, thin tube formed of ethylene vinyl acetate (EVA), open at one end and closed at an opposite end, said tube tapering outwardly from said closed end to said open end;

said tube being adapted to extend over the entire circumference of a finger from a fingertip to at least the third metacarpal-phalangeal joint, said tube extending substantially over at least the palmar surface and sides of the remainder of the finger;

said tube defining a grooved needle seat on an outer surface of said closed end.

9. The finger protector of claim 8 wherein said thin tube is thermoformed and defines a smooth outer surface tapering outwardly from said closed end to said open end.

10. A finger protector for use by surgical personnel under a surgical glove during a surgical procedure to prevent a finger puncture or cut, said finger protector comprising:

a puncture- and cut-resistant flexible, thin tube formed of ethyl vinyl acetate (EVA), open at one end and closed at an opposite end, said tube tapering outwardly from said closed end to said open end;

said tube being configured and dimensioned to extend over the entire circumference of a finger from a fingertip to at least the third metacarpal-phalangeal joint;

said tube defining a grooved needle seat on an outer surface of said closed end;

said tube combining levels of proprioception and flexibility suitable for surgical purposes.

11. The finger protector of claim 10 wherein said thin tube is thermoformed and defines a smooth outer surface tapering outwardly from said closed end to said open end.

* * * * *